US007677939B2

(12) United States Patent
Dahl

(10) Patent No.: US 7,677,939 B2
(45) Date of Patent: Mar. 16, 2010

(54) ARM BRACE FOR SWIMMING

(75) Inventor: Nicolas Dahl, Duedin (NZ)

(73) Assignee: Finis Inc., Livermore, CA (US)

( * ) Notice: Subject to any disclaimer, the term of this patent is extended or adjusted under 35 U.S.C. 154(b) by 0 days.

(21) Appl. No.: 11/808,009

(22) Filed: May 31, 2007

(65) Prior Publication Data

US 2008/0081525 A1 Apr. 3, 2008

Related U.S. Application Data

(60) Provisional application No. 60/810,280, filed on Jun. 1, 2006.

(51) Int. Cl.
*A63B 31/10* (2006.01)

(52) U.S. Cl. ..... 441/58

(58) Field of Classification Search ..... 441/56, 441/58, 59; 294/26, 25; 224/219; 482/139
See application file for complete search history.

(56) References Cited

U.S. PATENT DOCUMENTS 3,178,724 A * 4/1965 Perschke ..... 2/16
4,300,759 A * 11/1981 Caplan ..... 482/111
5,304,080 A * 4/1994 Dilger ..... 441/58
5,409,451 A * 4/1995 Daneman ..... 602/21
5,624,388 A * 4/1997 Lehr ..... 602/20

* cited by examiner

*Primary Examiner*—Stephen Avila
(74) *Attorney, Agent, or Firm*—JAG Patent Services LLC

(57) ABSTRACT

The present invention is directed to an arm-brace for improving the efficiency of a swimmer's stroke. In accordance with the embodiments of the invention, the arm brace includes a first closed loop and a second closed loop that together form a figure-eight configuration. The first closed loop and the second closed loop are preferably at an angle with respect to each other such that the swimmer's hand is positionable through a portion of the first closed loop and the swimmer's forearm is positionable through the second closed loop. The arm brace is configured to control an angle between the swimmer's elbow and wrist in order to promote early vertical forearm positioning as the swimmer's arm moves through a catch phase of a swimming stroke.

8 Claims, 7 Drawing Sheets

ARM BRACE FOR SWIMMING

RELATED APPLICATIONS

This Application claims priority under 35 U.S.C. §119(e) from the U.S. Provisional Patent Application Ser. No. 60/810,280, filed on Jun. 1, 2006, and titled "ARM BRACE FOR SWIMMING", the contents of which are hereby incorporated by reference.

FIELD OF THE INVENTION

This invention relates to aquatic articles. More particularly, the present invention relates to aquatic articles for teaching proper swimming techniques.

BACKGROUND OF THE INVENTION

A number of aquatic articles are available for swimming and other water activities. For example, there are snorkels, face masks, fins and goggles to name a few. There are also wet suits, swimming suits and other articles of clothing that are used by swimmers and divers alike. A number of aquatic articles have been developed to help swimmers develop or maintain proper swimming techniques.

One of the most important swimming techniques for swimming competitively is the stroke. A dropped elbow position, or low elbow profile, while stroking through water is a common technical mistake that swimmers make. Such positioning of the elbow causes pressure to be exerted on the water in a vertical direction as opposed to the preferred horizontal direction and thus reduces the efficiency of the stroke. Swimmers can correct the aforementioned technical mistake by assuming or maintaining a high elbow position, or high elbow profile. This positioning leads to more efficient stroking, stroking consistency, and can reduce the probability of injury.

Swimmers often train with paddles to help improve stroking strength and endurance. However, with paddles the swimmers cannot feel the water flow or pass over their hands as they stroke through the water. As a result, when the swimmers remove the paddles they tend to overcorrect or over compensate their stroke, thus creating other technical problems. Accordingly, there is a need for a system and device that helps swimmers maintain a high profile elbow position or profile through the stroke and thus improve their stroking technique.

SUMMARY OF THE INVENTION

The present invention is directed to an arm brace for improving the efficiency of a swimmer's stroke. The arm brace helps to hold the swimmer's wrists, elbows and shoulders at the optimal position during stroking, which helps the swimmer to focus on technique development as opposed to strength building. The arm brace of the present invention can be used in combination with paddles to help a swimmer develop his or her overall stroking technique.

In accordance with the embodiments of the invention, an arm brace is configured to control angles between the swimmer's elbows and wrists as the swimmer moves through the "catch phase" of the stroke. This is accomplished indirectly by immobilizing or controlling the angles between the swimmer's hands and the swimmer's forearms using arm braces, such as described below.

The system of the invention preferably includes a set of arm braces. Each arm brace includes a first loop portion and a second loop portion. The first loop portion is configured for wrapping around a hand of the swimmer and the second loop portion is configured for wrapping around the forearm of the swimmer.

In accordance with an embodiment of the invention, each of the arm braces is configured to have its respective first loop portion and second loop portion positioned at an angle with respect to each other through a center portion. Preferably, the center portion of the arm brace is configured to be positioned under the swimmer's forearm with the swimmer's hands positioned through the first loop and the swimmer's forearms positioned through the second loop of the arm brace.

In accordance with further embodiments of the invention, the angle between the first loop portion and the second loop portion and/or a distance between the first loop portion and the second loop portion of the arm brace is adjustable through an adjustable center portion. For example, the center portion is configured to be pliable or malleable and/or extendable, such that the position of the first loop portion and the second loop portion are selectable by the swimmer.

In accordance with a preferred embodiment of the invention, the arm brace, such as described above, is formed as a monolithic unit from a polymeric material, such as plastic or rubber. Preferably, the polymeric material is injection molded to form an arm brace with a first closed loop and a second closed loop. Most preferably, the first closed loop and the second closed loop form a figure-eight configuration and are positioned at an angle of between 175 and 110 degrees with respect to each other. Also, edges of the first closed loop and the second closed loop are flattened, curved and/or contoured in any number of ways to provide a snug, mated and/or comfortable fit against surfaces of the swimmer's hands and forearms with the swimmer's hands positioned through the first closed loop and the swimmer's forearm positioned through the second closed loop of the arm brace.

DETAILED DESCRIPTION OF THE INVENTION

Figure 1A:
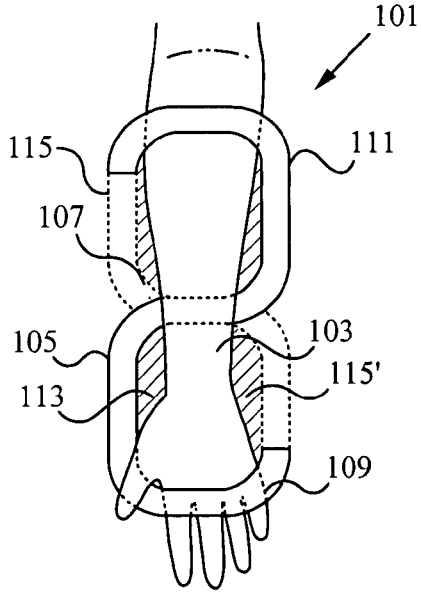
FIGS. 1A-E illustrate an arm brace, in accordance with the embodiments of the invention.
Figure 1B:
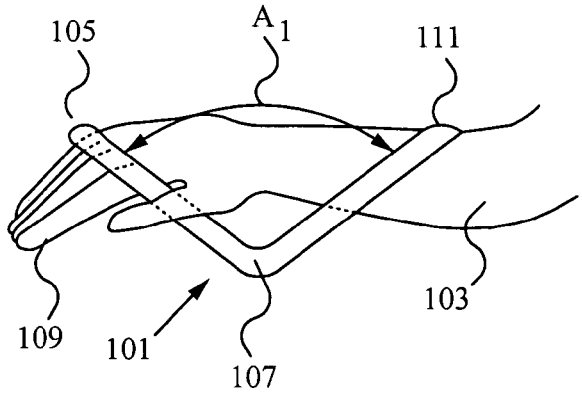
Figure 1C:
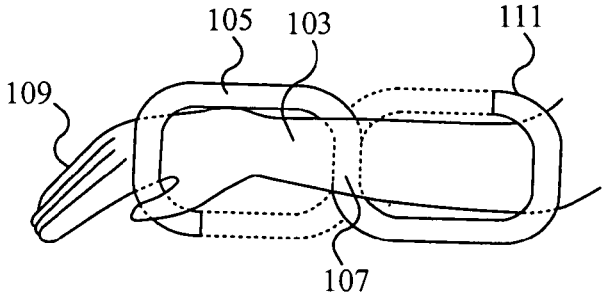
Figure 1D:
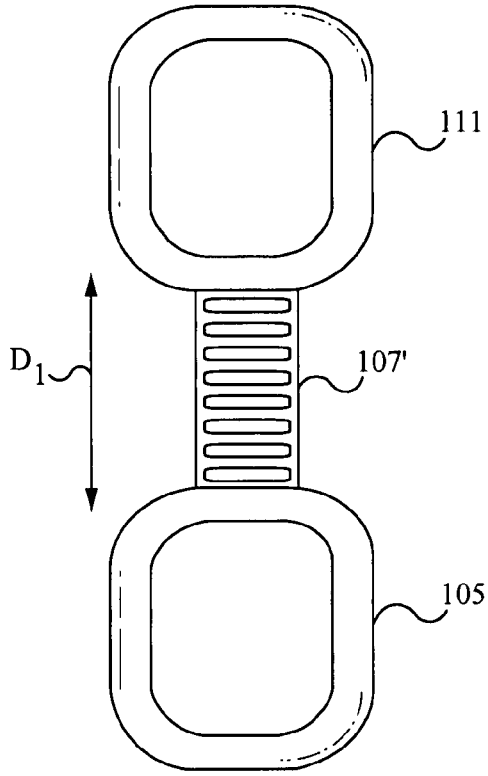
Figure 1E:
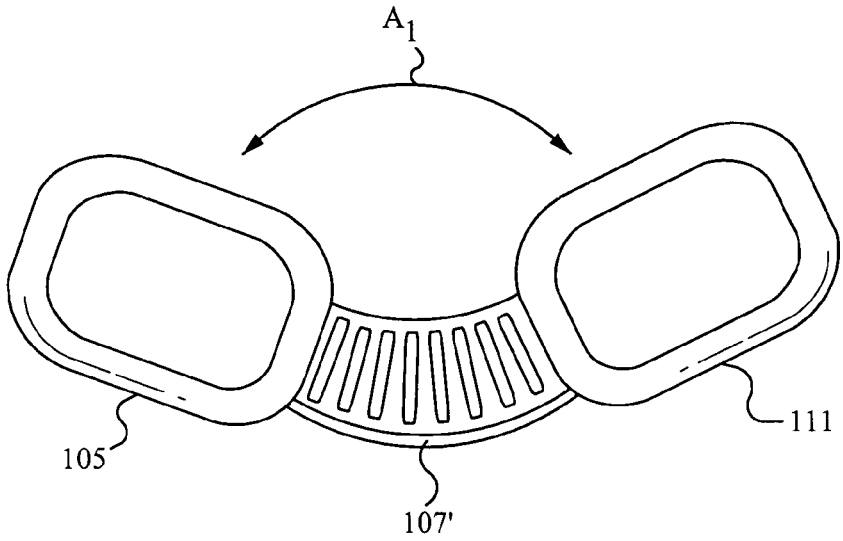

FIGS. 1A-E illustrate a system in accordance with the embodiments of the invention. The system includes at least one arm brace 101. The arm brace 101 includes a first loop portion 105 and a second loop portion 111. The first loop portion 105 is configured for wrapping around a hand 109 of the swimmer and the second loop portion 111 is configured for wrapping around the forearm 103 of the swimmer.

In an alternative embodiment of the invention the first portion 105 is sold or partially solid as indicated by the hatched area 113. As long as a portion of the swimmer's hand, such as a thumb, can extent over the first portion 105, the arm brace 101 will promote a preferred "early vertical forearm positioning" as the swimmer's arm moves through a catch phase of a swimming stroke.

In accordance with an embodiment of the invention, the arm brace 101 is configured to have the first loop portion 105 and the second loop portion 111 positioned at an angle $A_1$ with respect to each other through a center section or portion 107. Preferably, the center section or portion 107 of the arm brace 101 is configured to be positioned under the swimmer's forearm 103 with the swimmer's hand 109 positioned through the first loop 105 and the swimmer's forearm 103 positioned through the second loop 111 of the arm brace 101.

In accordance with the embodiments of the invention, the angle $A_1$ between and/or a distance $D_1$ between the first loop portion 105 and the second loop portion 111 of the arm brace 101 is adjustable through an adjustable center section or portion 107'. For example, the adjustable center section or portion 107' is configured to be pliable or malleable and/or extendable, such that the positions of the first loop portion 105 and the second loop portion 111 are selectable by the swimmer. The first loop portion 105 and the second loop portion 111 of the arm brace 101 are not required to be closed loop structures. Specifically, either the first loop portion 105, the second loop portion 111 or both can in accordance with the present invention be open loop structures, as indicated by the dotted lines 115 and 115'.

Figure 2:
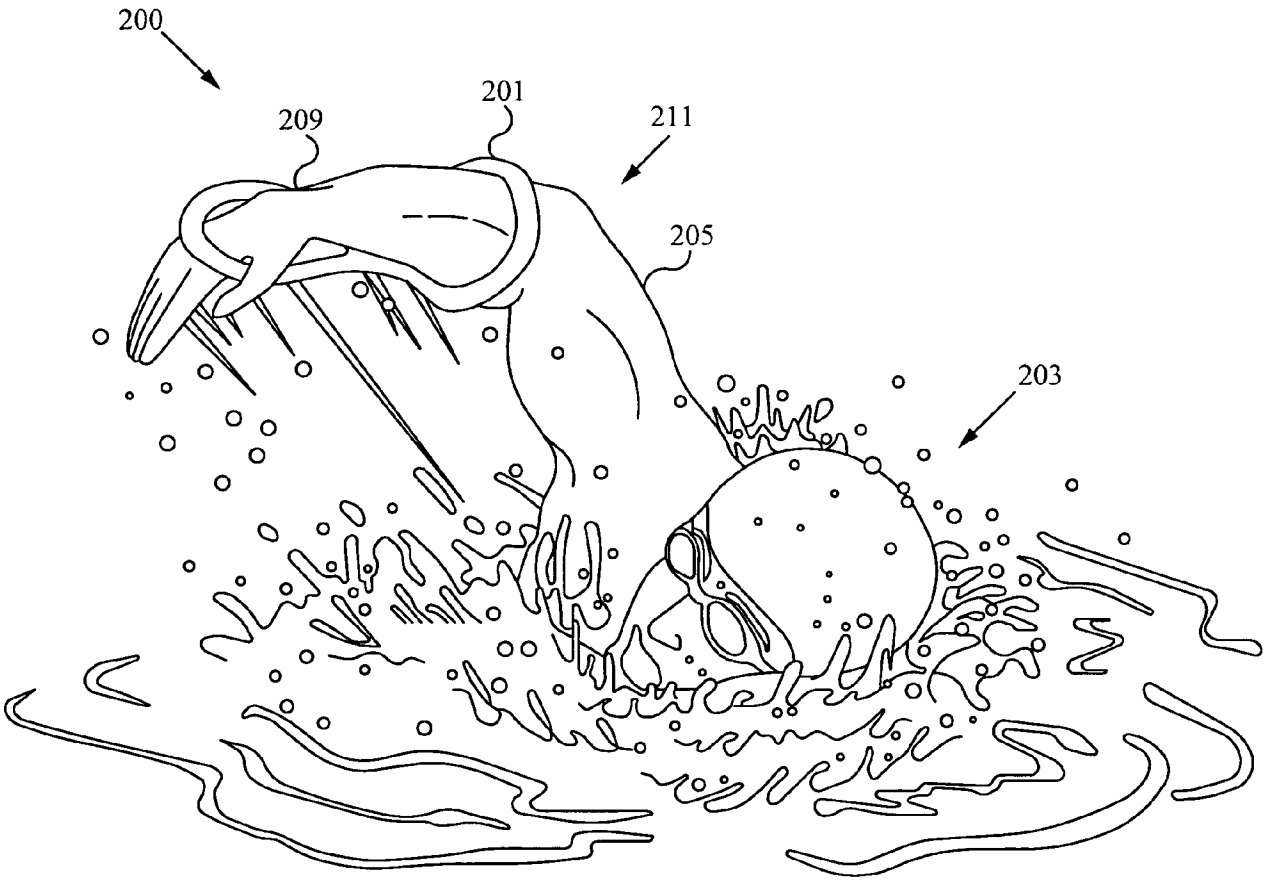
FIG. 2 shows a view of a swimmer using an arm brace, in accordance with the embodiments of the invention.

FIG. 2 shows a view 200 a swimmer 203 using an arm brace 201, in accordance with the embodiments of the invention. The arm brace 201 helps to control the positioning and angle between the swimmer's elbow 211 and the swimmer's wrist 209 as the swimmer's arm 205 moves into and through the "catch phase" of a swimming stroke.

FIGS. 3A-E illustrate views of a closed-loop or figure-eight arm brace 301, in accordance with a preferred embodiment of the invention. The arm brace 301 is formed as a monolithic unit and is formed from a polymeric material, such as plastic or rubber. Preferably, the polymeric material is injection molded to form the arm brace 301 with a first closed loop 305 and a second closed loop 311. The first closed loop 305 and the second closed loop 311 are preferably coupled together through a resilient, solid and/or semi-rigid center section or portion 307. In accordance with the embodiments of the invention, the first closed loop 305 enclosed a smaller area than enclosed by the second closed loop 311.

Figure 3A:
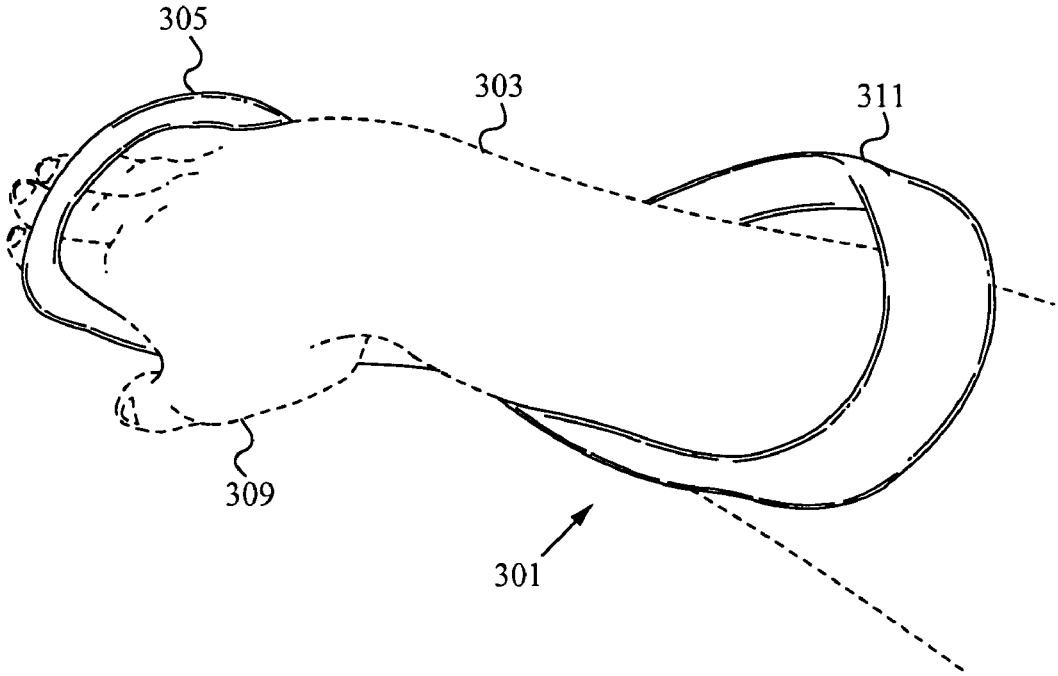
FIGS. 3A-G illustrate views of the closed-loop or figure-eight arm brace, in accordance with a preferred embodiment of the invention.
Figure 3B:
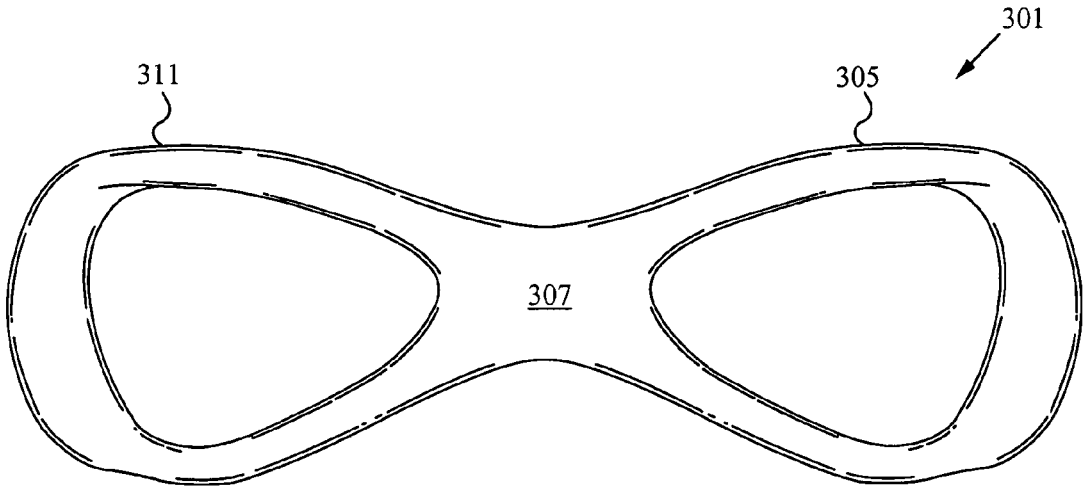
Figure 3C:
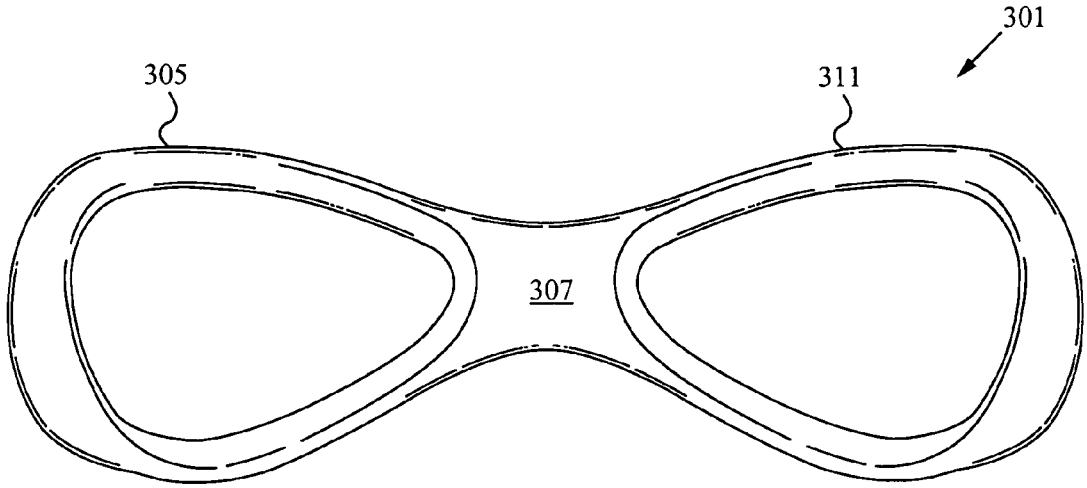
Figure 3D:
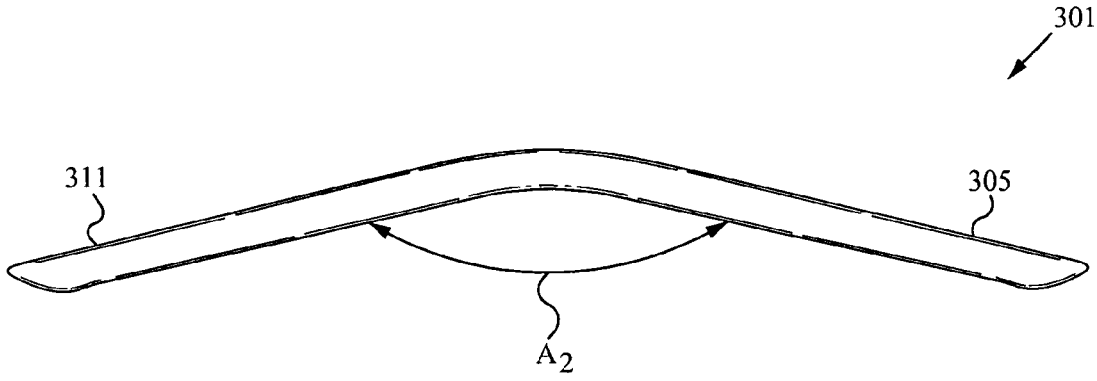
Figure 3E:
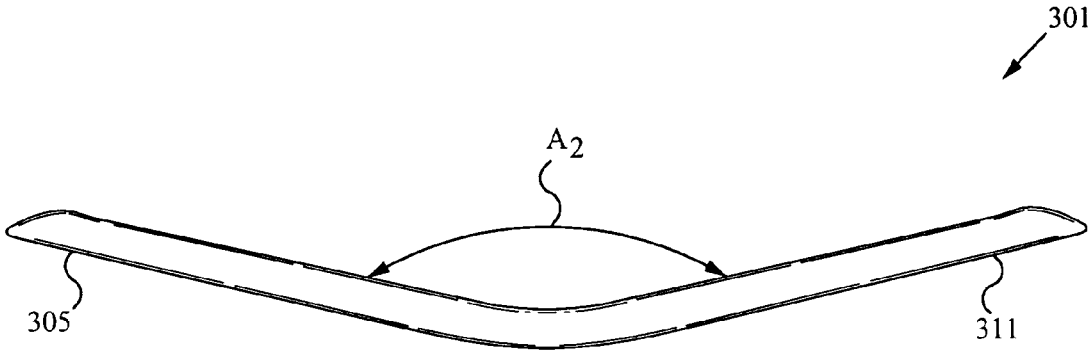
Figure 3F:
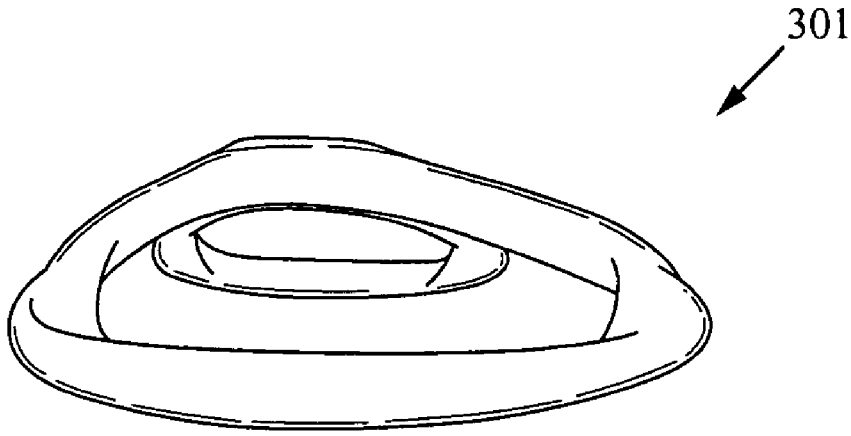
Figure 3G:
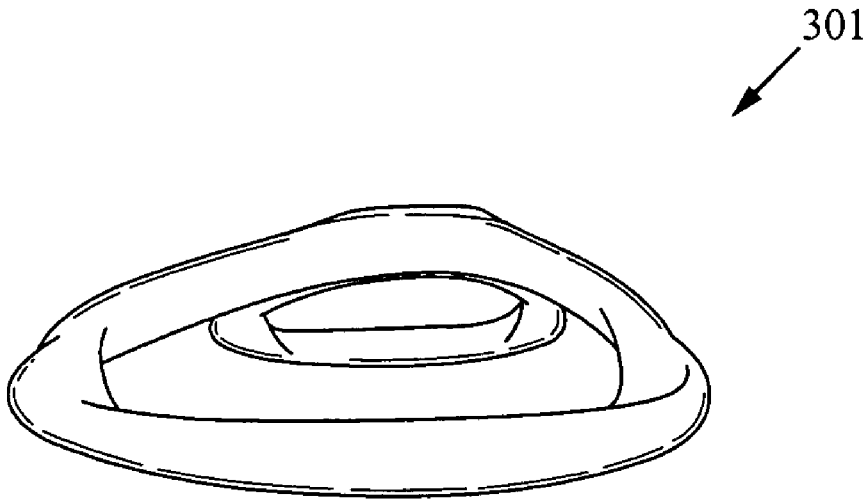

Most preferably, the first closed loop 305 and the second closed loop 311 form a figure-eight configuration and are positioned at an angle $A_2$ between 175 and 110 degrees with respect to each other (FIGS. 3D-E). Also, edges of the first closed loop 305 and the second closed loop 311 are curved or contoured, as shown, to provide a snug, mated and/or comfortable fit against surfaces of the swimmer's hand 309 and forearm 303 with the swimmer's hand 309 positioned through the first closed loop 305 and the swimmer's forearm 303 positioned through the second closed loop 311 of the arm brace 301 (FIG. 3A). FIGS. 3B-C show top and bottom views, respectively, of the arm brace; FIGS. 3D-E show side views, respectively, of the arm brace 301; and FIGS. 3F-G show front and back views, respectively, of the arm brace 301.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. An immobilizing arm brace comprising:

a) a first flattened loop portion for wrapping around a user's hand while swimming; and b) a second flattened loop portion for wrapping around the user's forearm while swimming, wherein the first flattened loop portion and the second flattened loop portion are positioned at a fixed angle of between 175 and 110 degrees during use and wherein the first flattened loop portion and the second flattened loop portion are formed from a molded polymeric material, wherein the first loop and second loop immobilize the user's wrist, wherein at least one of the first flattened loop portion and the second flattened loop portion are closed loop portions.

2. The immobilizing arm brace of claim 1, wherein the first flattened loop portion and the second flattened loop portion form a figure-eight.

3. The immobilizing arm brace of claim 1, wherein the first flattened loop portion encloses a smaller area than an area enclosed by the second flattened loop portion.

4. A method of making an immobilizing arm brace for swimming, the method comprising;

a) providing a polymeric material; and b) forming the polymeric material into a solid monolithic semi-rigid monolithic figure-eight configuration with a first closed loop portion for wrapping around a user's hand and a second closed loop portion for wrapping around the user's forearm, wherein the first closed loop portion and the second closed loop portion are positioned at a fixed angle with respect to each other, wherein forming the polymeric material comprises injection molding the polymeric material into the figure-eight configuration.

5. The method of claim 4, wherein the fixed angle is in a range of 175 and 110 degrees.

6. A system comprising a set of immobilizing arm braces for controlling angles between hands and elbows of a swimmer as the swimmer strokes through water, each of the arm braces comprising a first closed loop for wrapping around the hands and a second closed loop for wrapping around forearms of the swimmer, wherein the first closed loop and the second closed loop form a semi-rigid figure-eight configuration and wherein the first closed loop and the second closed loop are configured to be at a fixed angle in a range of 175 and 110 degrees with respect to each other such that wrists of the swimmer are immobilized, wherein the semi-rigid figure-eight configuration is monolithic.

7. The system of claim 6, wherein the first closed loop and the second closed loop are fixed together through a resilient, solid and/or semi-rigid center portion.

8. The system of claim 7, wherein the resilient, solid and/or semi-rigid center portion is adjustable.

* * * * *